US008061252B2

(12) United States Patent
Marks

(10) Patent No.: US 8,061,252 B2
(45) Date of Patent: Nov. 22, 2011

(54) HOLE PUNCH ELEMENT

(75) Inventor: Joel S. Marks, Sherman Oaks, CA (US)

(73) Assignee: Worktools, Inc., Chatsworth, CA (US)

( * ) Notice: Subject to any disclaimer, the term of this patent is extended or adjusted under 35 U.S.C. 154(b) by 0 days.

(21) Appl. No.: 11/835,319

(22) Filed: Aug. 7, 2007

(65) Prior Publication Data

US 2007/0267472 A1 Nov. 22, 2007

Related U.S. Application Data

(63) Continuation of application No. 11/215,423, filed on Aug. 30, 2005, now abandoned.

(51) Int. Cl.
*B26D 5/08* (2006.01)
*B26F 1/14* (2006.01)
*B21D 28/34* (2006.01)

(52) U.S. Cl. ..... 83/698.91; 83/633; 83/690; 83/689

(58) Field of Classification Search ..... 83/618, 83/55, 686, 687, 689, 669, 664, 685, 690, 83/691–693, 633–635, 620, 622, 627, 628
See application file for complete search history.

(56) References Cited

U.S. PATENT DOCUMENTS

| | | | | |
|---|---|---|---|---|
| 430,168 | A * | 6/1890 | Brown | 83/468.93 |
| 926,261 | A * | 6/1909 | Krag | 83/468.9 |
| 1,785,495 | A | 12/1930 | Richard | |
| 3,073,199 | A * | 1/1963 | Yerkes | 83/549 |
| 3,320,843 | A | 5/1967 | Schott, Jr. | |
| 3,461,756 | A * | 8/1969 | Mojonnier | 83/17 |
| 3,714,857 | A | 2/1973 | Stuertz et al. | |
| 3,721,144 | A | 3/1973 | Yamamori | |
| 4,077,288 | A | 3/1978 | Holland | |
| 4,240,572 | A | 12/1980 | Mitsuhashi | |
| 4,257,300 | A | 3/1981 | Muzik | |
| 4,449,436 | A | 5/1984 | Semerjian et al. | |

(Continued)

FOREIGN PATENT DOCUMENTS

DE 296 15 032 U1 * 10/1996

(Continued)

OTHER PUBLICATIONS

Extended European Search Report issued by the European Patent Office, dated Nov. 12, 2009.

*Primary Examiner* — Ghassem Alie
*Assistant Examiner* — Bharat C Patel
(74) *Attorney, Agent, or Firm* — Paul Y. Feng; The Eclipse Group LLP

(57) ABSTRACT

A hole punch device that reduces the force required to create a hole in papers or other sheet media. A punch element of the hole punch device includes a locally sloped or indented floor to create a bend in the sheet media as it is punched to create an enlarged, oval hole. The punch pin may include an expanding sleeve surround the pin that forms a larger diameter during the cutting stroke and springs back to a smaller diameter during a pull out stroke. A coiled torsion return spring is positioned remotely from and non-coaxially with the punch pin. A keyed pin and support frame arrangement ensures a predetermined rotational orientation of the pin for sequential cutting for reduced cutting force. A long lead-in surface in the frame helps installing sheet media into the feed slot of the punch element.

5 Claims, 3 Drawing Sheets

U.S. PATENT DOCUMENTS

| | | | | | |
|---|---|---|---|---|---|
| 4,594,927 | A | | 6/1986 | Mori | |
| 4,623,089 | A | | 11/1986 | Scott | |
| 4,656,907 | A | | 4/1987 | Hymmen | |
| 4,713,995 | A | * | 12/1987 | Davi | 83/167 |
| 4,757,733 | A | * | 7/1988 | Barlow | 83/588 |
| 4,763,552 | A | | 8/1988 | Wagner | |
| 4,829,867 | A | | 5/1989 | Nielsen | |
| 4,898,056 | A | | 2/1990 | Grobb et al. | |
| 5,243,887 | A | | 9/1993 | Bonge, Jr. | |
| 5,463,922 | A | | 11/1995 | Mori | |
| 5,611,254 | A | | 3/1997 | Rall | |
| 5,638,730 | A | | 6/1997 | Karlis | |
| 5,730,038 | A | * | 3/1998 | Evans et al. | 83/686 |
| 5,813,301 | A | | 9/1998 | Fujita | |
| 6,688,199 | B2 | | 2/2004 | Godston et al. | |
| 2005/0145085 | A1 | * | 7/2005 | Lee | 83/618 |
| 2005/0211041 | A1 | | 9/2005 | Oh | |

FOREIGN PATENT DOCUMENTS

| | | | | |
|---|---|---|---|---|
| DE | 29615032 | U1 | * | 10/1996 |
| EP | 1332845 | A2 | | 8/2003 |
| GB | 1549499 | | | 8/1979 |
| GB | 1568124 | | | 5/1980 |
| JP | 61-172629 | | | 8/1986 |
| JP | 64-087192 | | | 3/1989 |
| JP | 04059138 | A | * | 2/1992 |

* cited by examiner

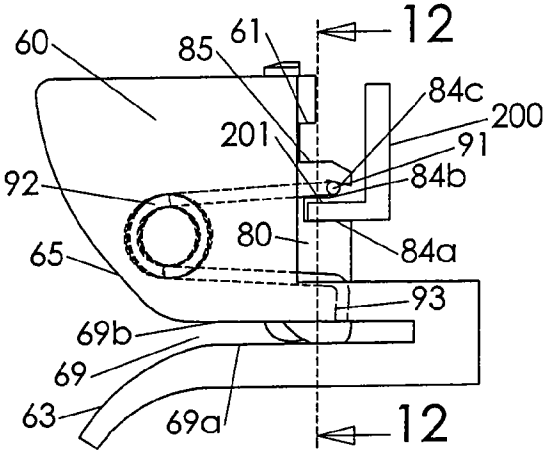
Fig. 11
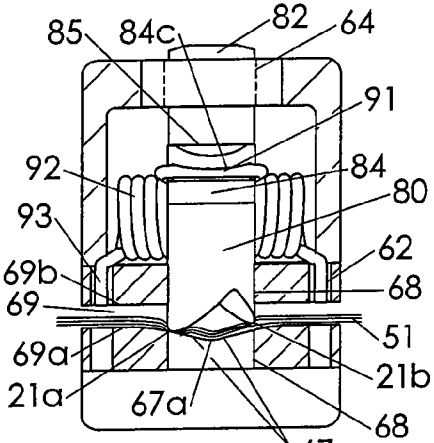
Fig. 12
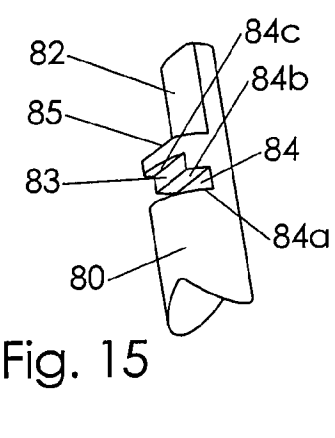
Fig. 15
Fig. 14
Fig. 16
Fig. 13

HOLE PUNCH ELEMENT

CROSS-REFERENCE TO RELATED APPLICATIONS

This application is a continuation application of U.S. application Ser. No. 11/215,423, filed Aug. 30, 2005, whose entire contents are hereby incorporated by reference.

FIELD OF THE INVENTION

The present invention relates to hole punching devices used to cut holes in sheet material. More precisely, the present invention relates to a punch pin and support structure.

BACKGROUND OF THE INVENTION

A paper punch is a common device found in offices and schools. It is used to cut holes in paper under finger or hand pressure. Typically, a paper punch element includes a pin, and a frame to support the pin over a paper slot. The pin moves axially, or vertically, into the papers. It is desirable to minimize the force required to cut a hole into a stack of papers since these tools are usually operated under hand or finger pressure. To be sure, even a motorized paper punching device benefits from reduced force since a smaller motor may be used.

One method to reduce this force is to cut progressively around the perimeter of a hole rather than to cut the entire perimeter of the hole all at once. A well-known method for making a progressive cut is with a "V" cut notch in the end face of the pin. This creates more than one cutting point. The notched end cuts from two opposed sides of the hole toward the center of the hole. The notched end provides two equal pointed ends of the pin that press the paper stack simultaneously. Other designs use asymmetrical points or three or more cutting points.

Another concern is jamming of the pin in the paper. Typically, as the pin advances into the hole, the inside diameter edge of the paper is stretched and dragged down into the hole along with the pin. Then as the pin is withdrawn out of the hole, the edges tend to flip upward and press hard around the pin in a cam action. The hole effectively acts as a one-way cleat, with the hole inner diameter serving as a diaphragm to hold the pin in the hole. The hole diameter cut in the paper is in fact smaller than the diameter of the pin.

The prior art paper hole punches typically contemplate a compression type die spring strong enough to overcome the highest anticipated pull out or retraction force. The pin can typically be retracted only by the spring. Therefore, the spring must provide that function under all circumstances. U.S. Pat. No. 4,757,733 (Barlow) shows a typical arrangement in FIG. 6. Ridge 40 transmits pressure to cap 47 atop each pin (cutting tool 15). Helical spring 45 surrounds the pin. When the pin does not retract in this type of design, the paper becomes jammed in the punching device since there is no further way to force the pin out. This situation is familiar to most users of paper punches. Also, the force needed to compress the die spring directly adds to the hand or operating force required to cut the hole. When a small stack of papers is being cut, the spring force is often greater than the actual cutting force.

There are many hole punch tool and pin designs. For example, U.S. Pat. No. 5,730,038 (Evans et al.) shows a punch pin cutting end with specified groove depth in relation to a paper stack height, and a force sequence profile. U.S. Pat. No. 5,243,887 (Bonge, Jr.) shows a rectangular punch 18 fitted in the rectangular guide hole of a frame. The punch is pivotably attached to a lever and secured axially by pin 24. U.S. Pat. No. 4,763,552 (Wagner) discloses a punch pin with a symmetric angled cutting end. U.S. Pat. No. 4,713,995 (Davi) shows a conventional punch element design, including a helical return spring around the pin, and a lever that can only press, not pull, the pin. U.S. Pat. No. 4,449,436 (Semerjian, et al.) shows a cylindrical punch pin that includes a slotted top. A lever rib normally engages the top of the punch pin. An inoperative position for the sheet punch is achieved by rotating the punch pin so that the slot aligns with the lever rib. The rib then moves into the slot rather than pressing the top of the pin. No apparent mechanism is disclosed to keep the punch pin in its operative rotational position. The Semerjian '436 patent furthers shows an asymmetrical pin with one cutting point longer than another.

U.S. Pat. No. 4,257,300 (Muzik) discloses a cylindrical punch pin where the pin is secured axially at an annular groove. A key fitted in a radial slot of the pin positions the pin rotationally. U.S. Pat. No. 3,721,144 (Yamamori) shows a tubular punch die element with thin walls and a sharpened lower end. U.S. Pat. No. 3,320,843 (Schott, Jr.) shows a tubular punch element that is ground sharp at its cutting end. U.S. Pat. No. 4,594,927 (Mori) shows a punch pin held axially in two ways. In one embodiment, a rod 10 passes through a drilled hole in the upper body of the punch pin. Alternatively, an annular groove fits in a slot of a pressing plate. With the annular groove, the punch pin is not rotationally fixed in position. The Mori '927 patent shows an inclined base where the pins cut holes in a progressing sequence. The angle is very slight, just adequate to create the sequential cuts while maintaining a reasonable height to the punch device. U.S. Pat. No. 4,656,907 (Hymmem) shows a paper punch that may be disassembled for, among other reasons, to fix jammed pins. U.S. Pat. No. 4,240,572 (Mitsuhashi, et al.) shows a multi-pointed punch pin including a discussion of a punching sequence. U.S. Pat. No. 5,463,922 (Mori) shows a roller system for pressing punch pins in a sequence.

Japanese Patent Publication No. 64-087192 (Izumi, et al.) shows a punch pin with elongated cutting points, and a graph showing two force peaks during the punching operation. Japanese Patent Publication No. 61-172629 (Yukio) shows different cutting end profiles for a punch pin, including an asymmetrical end. U.S. Pat. No. 4,829,867 (Neilsen) shows a fixed diameter sleeve type punch pin with a helical cutting end. U.S. Pat. No. 6,688,199 (Godston, et al.) and U.S. Pat. No. 4,077,288 (Holland) disclose punches with a vertically oriented or upright paper slot. In the Godson '199 patent, the surrounding structure 532 holds the papers away from the user. As illustrated in FIGS. 4 and 9, slot 62 including floor 64 and ceiling 68 are perpendicular to the punch pin axis 50.

SUMMARY OF THE INVENTION

It is desirable to minimize the peak forces to cut a hole or holes in papers or other sheet media in a finger- or hand-pressure operated tool or in a compact motorized tool. The shape at the end of the punch pin is important. One approach is to cut the notch so that the pointed cutting ends are at different levels. Then the lowest pointed end cuts into the paper or sheet first before the higher pointed end, so the force required is less than that with two equal elevation ends cutting into the paper or sheet simultaneously. One approach to creating different levels for the cutting points is to locate the notch in between the cutting points off-center. Another approach is to provide an uneven punch base so that the pointed ends cut into the sloped sheet differently.

To further improve the efficiency of a hole punch, the pull out force of the pin must be reduced. One way to reduce the force is to make the hole in the paper larger than the pin diameter. A non-circular inner circumference can make it easier to expand the hole about a circular pin. For example, an oval hole in a sheet with its largest diameter sized greater than the punch pin diameter would allow the punch pin to pull out easily. To create an oval hole with a circular pin, in one embodiment, the base or anvil of the frame should be substantially uneven or angled. The paper flexes out of a flat plane at the anvil. The pin thereby presses the paper at a substantial angle off perpendicular to the punch pin creating a slightly ovoid hole. With such an arrangement, the smaller diameter of the ovoid hole remains equal or smaller than the pin diameter, while the larger diameter of the ovoid hole is larger than the pin diameter. The pin can easily force open the narrow direction of the hole when the paper is repositioned perpendicular to the pin since the loose fitting larger diameter direction can flex toward the pin. The ovoid hole becomes slightly distorted into a round shape that is larger than the simple round hole that is ordinarily made by the pin.

Another approach to ease the pin removal is to use an expanding pin. In such an exemplary embodiment, a thin-walled sleeve includes an angled cutting end. The end is ground to a sharp edge and may cut progressively from one side of a hole toward the opposite side. In a preferred embodiment, the sleeve is formed from a sheet metal blank into a hollow cylinder, and includes a longitudinal gap between the two opposed edges of the formed blank.

The sleeve is expandable whereby it has a larger diameter as it is forced into the paper and a smaller diameter as it is pulled out. The longitudinal gap becomes larger allowing the sleeve to expand. The sleeve at least partially surrounds a punch pin. The punch pin includes a head at the top. Once assembled, the pin is slidable within the sleeve wherein the head is normally spaced above the top of the sleeve. Pressing the pin/sleeve assembly at the pin head into the paper sheet causes the pin to slide down with the head moving toward the sleeve. A groove around the circumference of the pin receives a radially inward facing rib formed in the sleeve, or equivalent structure, so that as the pin slides within the sleeve, the rib slips out of the groove and expands the diameter of the sleeve. During the downward cutting stroke, the expanded sleeve cuts a hole with a larger diameter than the sleeve diameter during the pull out stroke.

An approach to reduce punching effort is to minimize the return spring force. A return spring is commonly used to return the actuation handle back to the start position and to withdraw the punch pin from the punched hole in the sheet material. A first way to achieve a lighter spring force is to reduce the pull out force described above. A lighter spring provides a particular advantage in light duty use, but is also advantageous in any type of punching application. A second way to reduce return spring force is a simplified linkage that enables a user to directly pull out a pin from a punched hole. The return spring may then be just strong enough to retract the pin in most circumstances; the return spring need not be so strong that it can retract the pin under the worst case. Examples of such worst cases include when punching through a very thick stack of papers when the papers have some glue or other contamination, or when the pin has become dull and draws more paper edge into the hole. In such worst case instances, the user can augment the return spring power by pulling up upon an operating handle to retract the pin. Accordingly the spring force may be substantially reduced.

BRIEF DESCRIPTION OF THE DRAWINGS

FIG. 11 is a side elevational view of an alternative embodiment punch element with an actuating bar engaging a pin and a return spring in hidden view, with the assembly in an intermediate position.

FIG. 12 is a partial cross-sectional view of the punch element of FIG. 11.

FIG. 13 is a rear., side perspective view of the punch element of FIG. 11.

FIG. 14 is a side elevational view of the punch element of FIG. 11.

FIG. 15 is a rear side view of the punch pin of FIGS. 11 to 14.

FIG. 16 is a perspective view of a double torsion return spring.

DETAILED DESCRIPTION OF THE PREFERRED EMBODIMENTS

The present invention is directed to a hole punch element. A hole punch element may be defined as the punch pin, or as the structure within the immediate region of the hole punch device near the pin including the structures that guide the pin and the sheet media or substrate to be punched, such as a stack of papers. For example, a die cast punch support structure may guide pins as well as support an operating handle.

Figure 1:
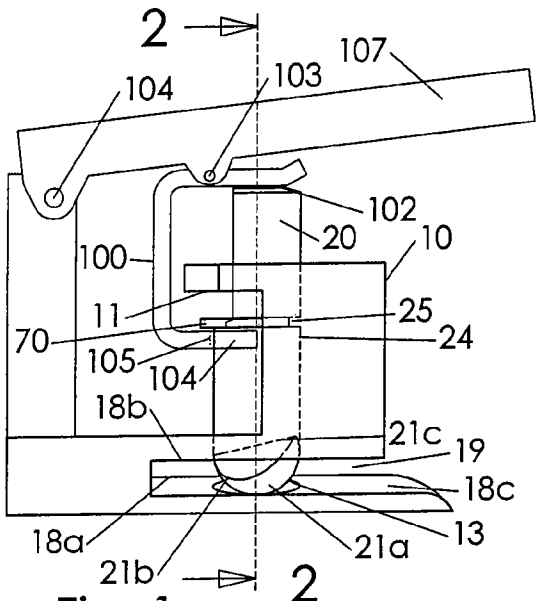
FIG. 1 is a side elevational view of a punch element with a pin shown in hidden view.

FIGS. 1 to 7 show one exemplary embodiment of an improved punch element. Pin 20 is vertically slidable and guided in frame 10 along a longitudinal pin axis, depicted as a vertical, dashed line. In FIG. 1, pin 20 is shown in an intermediate position between an uppermost position and a lowermost position. Lower cutting point 21*a* of pin 20 is just protruding into anvil cavity 13. Upper cutting point 21*b* of pin 20 has not entered cavity 13 in FIG. 1.

Tie bar 100 is linked to pin 20. Tie bar 100 is preferably a side facing "U" channel in the illustrated embodiment. Linkages acting as the tie bar of other shapes aside from a "U" channel are contemplated. In a multiple hole punch, such as a three hole punch, tie bar 100 actuates three punch elements spaced along a length of tie bar 100. Tie bar 100 links the pins to a further actuating mechanism shown schematically as handle 107. Handle 107 is pivotably attached to frame 10, either directly as shown at pivot 104 or to a housing body (not shown) that supports one or more frames or punch element portions and an actuating lever system. Handle 107 is also pivotably attached to tie bar 100. Some optional sliding motion is allowed at pivot 103 in the instance that handle 107 moves by rotation as shown. In the preferred embodiment, handle 107 can press downward upon tie bar 100 and optionally pull up on tie bar 100 via pivot 103.

Pin 20, tie bar 100, handle 107 or any combination of these components or equivalent structures may be driven not only by direct manual force of a user's hand but also by a motor or by hydraulics. For example, a motor (not shown) may rotate an eccentric cam and the cam selectively engages tie bar 100 from above to force tie bar 100 downward as in FIG. 1.

When a user depresses handle 107 which rotates about pivot 104, pivot 103 translates the rotational handle motion into a vertical translation of tie bar 100. Upper wall 102 of tie bar 100 presses atop pin 20 to urge pin 20 into papers 51 or other sheet material, as seen FIG. 2. Still in FIG. 2, lower wall 104 includes recess 105 formed into the lower edge of tie bar 100 to at least partially surround lower body portion 24 of pin 20. Spring clip 70 fits into circumferential groove 25 of pin 20. Lower wall 104 of tie bar 100 fits under spring clip 70 at recess 105. With the contacts at pivot 103 and/or spring clip 70, tie bar 100 can press pin 20 in a downward stroke in response to a user's pressing action upon handle 107. Moreover, as tie bar 100 is raised by handle 107 via pivot 103, tie bar 100 also lifts pin 20 in an upward stroke through the spring clip 70 linkage at recess 105. Therefore, a user may easily lift pin 20 directly if the pin becomes stuck in a hole that the pin cut into the stack of papers 51. This capability contrasts with the conventional light duty hole punch where an operating handle can only press punch pins, but cannot lift the pins since there is no tensile link to the pin to enable a retracting stroke.

The present invention exemplary embodiment provides a much simpler lifting mechanism than, for example, a pin that has a cross drilled hole holding a dowel used to attach the pin to a lifting arm to enable the lifting stroke. Cross drilling a cylindrical pin through its centerline is costly and difficult to manufacture.

Figure 2:
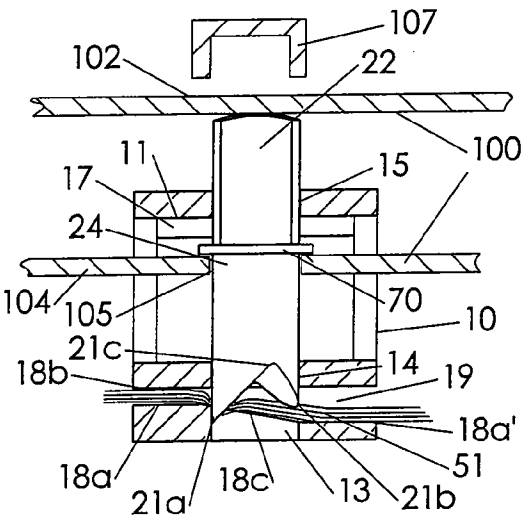
FIG. 2 is a partial cross-sectional front view of the punch element taken along line 2-2 of FIG. 1.
Figure 5:
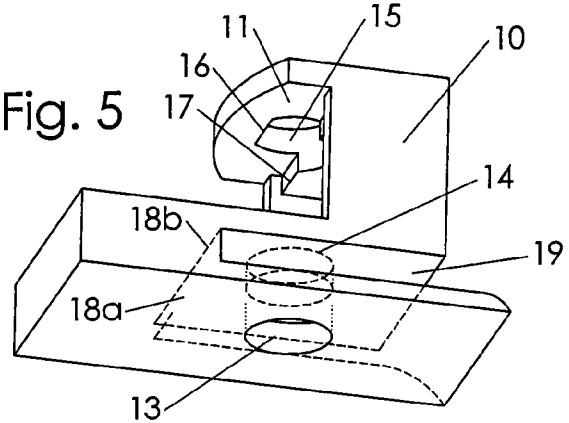
FIG. 5 is a side, bottom perspective view of the punch element frame of FIG. 1.

In FIGS. 2 and 5, shelf 17 provides an optional upper stop for spring clip 70. In FIG. 2 it is seen that shelf 17 is similar in thickness to lower wall 104 of tie bar 100. As pin 20 moves up to its upper most position, spring clip 70 contacts shelf 17. A gap remains to allow lower wall 104 of tie bar 100 to fit in between ceiling 11 of frame 10 and spring clip 70. Therefore, if the punch element is removed, for example to change its position from two hole punching to three hole punching, the gap between ceiling 11 and spring clip 70 remains so that the punch element can be reinstalled into recess 105 and linked to tie bar 100. The present embodiment thus benefits from quick and easy interchangeability of the punch elements. The gap also helps in initial manufacturing assembly of tie bar 100 about pin 20.

Frame 10 includes side walls and an opening facing rearward, in the leftward direction in FIG. 5, to create an optional, partially enclosed space. Pin 20 is therefore exposed rearward in frame 10. As best seen in FIG. 5, rearward is defined as the direction in which slot 19 terminates, which is opposite to the direction toward which slot 19 opens. This arrangement allows lower wall 104 of tie bar 100 to engage pin 20 using a simple recess 105 formed in an edge of tie bar 100. Accordingly, the aforementioned embodiment provides a punch pin that can be both pressed into and pulled out of sheet media via a simple linkage system.

Another feature of the preferred embodiment is a reduction in force needed to pull out a pin from a hole the pin has made in a stack of papers 51. In the embodiment shown in FIG. 2, slot 19 has upper floor 18*a* and lower floor 18*a*'. Slot 19 includes anvil cavity 13 formed in angled section floor 18*c*. Angled section floor 18*c* surrounds or nearly surrounds anvil cavity 13. Collectively, the floor sections 18*a*, 18*a*' and 18*c* form an uneven or stepped punch element floor. Preferably, angled section floor 18*c* is at a slope angle of about 5° to 25° inclusive across a diameter of pin 20, including all angles therebetween, relative to generally level floor 18*a* or 18*a*'. According to basic trigonometry, an angle of 25° across the pin diameter corresponds to an elevation change of about 50% of the pin diameter. An angle of 5° corresponds to an elevation change of about 8% of the pin diameter. Alternatively, the uneven or stepped floor may be locally steeper than the given range of 5° to 25°. In such an embodiment, a nearly vertical or entirely vertical region of anvil cavity 13 can be formed in an area smaller than the diameter of pin 20 in combination with or in place of the larger-area, 5°-to-25° sloped section floor 18*c*. According to the trigonometric relationship described above, in this smaller area, the elevation change across the pin diameter preferably ranges inclusively from about 8% to 50% of the pin diameter. In still other alternative embodiments, sloped section floor 18*c* may be angled anywhere from about 2° to 90° inclusive.

The distance between upper floor 18*a* and ceiling 18*b* may be a paper thickness limit. More generally, the smallest height of slot 19 can serve as the paper thickness limiter, and in FIG. 2, this is the height at the left side of slot 19 or the distance between 18*a* and 18*b*. The paper thickness limit defines the capacity of the punch element or hole punch device and restricts the punch element or hole punch device to use with a pre-determined number of sheets of a given thickness paper. The capacity may be selected to match available leverage or pressing force, or for marketing reasons.

Another way to describe the locally angled or stepped section floor is in relation to a paper guide slot in a multi-element hole punch. In such an assembly of a hole punch structure (not shown), two or more punch elements are spaced side-by-side. Each punch element appears as in FIG. 2 to provide for separate holes in a stack of papers. Slots 19 of the two punch elements define the paper guide slot, with co-planar floors 18*a* or 18*a*' being the bottom of the slot. The paper normally lies in the plane defined by floors 18*a* or 18*a*'. This plane may be called the "slot plane." This plane may be visualized in its relevant direction by extending the opposed edges of papers 51 of FIG. 2. It may be described by a general level for floors of adjacently spaced punch elements that hold the position of papers 51 as defined by the same position on each punch element, for example, floor 18*a* of each punch element. Angled section 18*c* is therefore described as a bent area local to pin 20 that is sloped at about 5° to 25° out of plane, or comparably, an elevation change of about 8% to 50% of the pin diameter across pin 20. This local bent area in floor 18*c* guides and offsets the paper stack out of the slot plane near pin 20 when the paper stack is compressed by pin 20. In an alternative embodiment, the slot floor may include local arcuate portions to create such an offset.

Notably, the term "plane" is intended to include a non-linear, sloped, and/or arcuate floor for the in and out direction, or left to right in FIG. 1. The "paper path" defined by floor 18*a*, 18*a*' and angled section floor 18*c* may alternatively be described as a bent line bisecting the respective pin axes of the multiple elements rather than a bent plane connecting the multiple elements. The paper is bent to follow the uneven or kinked paper path as pins 80 of multiple punch elements press the paper against respective bases of the elements.

In a conventional, multiple punch element design, the floors define a straight, smooth, and slightly inclined path. In contrast, angled or stepped section floor 18*c* or equivalent structure in the preferred embodiment of the present invention defines an offset, out-of-plane or out-of-line section from the generally straight inclined path to create a local bend in papers proximate to each pin. In the instance of a smooth inclined path, if ceilings 18*b* of the respective elements are at the same level, then the slot height is different for each element. Typically, the smallest height portion of the smallest slot 19 defines the maximum paper thickness in the multiple-element hole punch device.

As seen in FIG. 2, when pin 20 presses on papers 51 held in slot 19, the papers are forced to bend to follow the surface contour of angled section 18*c*. As a result, the angled entry of pin 20 into the papers causes the apparent shape of pin 20 at the papers to be an oval. The resulting hole created by pin 20 in papers 51 is also an oval with its long axis or diameter slightly larger than the actual diameter of pin 20.

Optionally, the entire surface of the floor may be angled as with angled section floor 18*c* to form the out of path section. In this embodiment, the formerly level surfaces of floors 18 and 18*a* would now be sloped. This works best if the floor surface generally underlying the punch element is narrow from side to side to avoid a large elevation change from one side of the pin to the other. That local area generally underlying the pin may span a width of just smaller than the pin diameter to a width of up to about 5 pin diameters. By further extending the size of the angled section of floor 18*a* and 18*c*—higher on the left in FIG. 2 and lower on the right—papers 51 will be offset more than necessary. The extreme offset may be apparent to a user who might find the appearance peculiar, and may hinder the ease with which papers can be fed into slot 19. Consequently, the extreme offset requires an excessively tall slot 19 for clearance, which carries over into undesired increased bulk of the hole punch device.

Similarly, a highly inclined path connecting together multiple punch elements can provide oval holes. However, the resulting slot height at the lowest area of the floor would be unsatisfactory for typical spacing between multiple punch elements. It is thus desirable to have a substantially inclined floor or path, but with a size limited to the immediate vicinity of the pin. With this arrangement can the hole be usefully oval while maintaining a reasonable slot height for all punch elements and surrounding support structures.

The force of adhesion of pin 20 with the inside wall of the punched hole is reduced when the hole is oval shaped and the pin cross-section is a circle. The benefit is greatest if papers 51 are tilted from the angled position to a perpendicular position about pin 20 before the pin is withdrawn. In the angled position, the oval hole remains tightly fit around the pin since the hole was created in this condition. But if the paper is tilted to be substantially perpendicular to pin 20, the hole effectively expands to be larger than the pin diameter along the long axis of the oval hole. The short axis remains the same size relative to the pin. As mentioned above, the slope of angle section 18*c* relative to the horizontal floor 18*a* should preferably be greater than about 5° or the oval shape will be too subtle to be very effective. If the angle is greater than about 25° across the pin diameter, pin 20 might slide along papers 51 more than actually cutting through the papers. Also, the pin will be too strongly biased off the pin axis by the angled entry into the papers and might not properly enter anvil cavity 13. Through empirical observations, the slope angle is more preferably about 10° to 15° inclusive including all values between the limits and most preferably about 11° to optimize the above-mentioned benefits.

Figure 6:
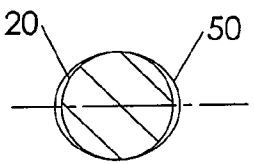
FIG. 6 is a cross-sectional view of the pin within an oval hole formed in a stack of papers.

In FIG. 2, floor section 18*c* is angled off the perpendicular with respect to the pin axis, while ceiling 18*b* is horizontal. As pin 20 is withdrawn in an upward stroke, papers 51 tend to adhere to the pin. The papers are pulled up against ceiling 18b. At this moment, papers 51 are tilted and re-oriented toward the perpendicular since ceiling 18*b* is perpendicular to the axis of pin 20. As a result and as shown in FIG. 6, oval hole 50 then has a loose fit about the circular cross-section of pin 20. In its more flat orientation, oval hole 50 is generally larger in area than pin 20 and contacts the pin only at the two tangential areas shown in FIG. 6. The hole is thus easily distorted toward a round shape to fit loosely about pin 20, enabling a low force withdrawal of pin 20 out of the punched hole. A conventional round hole or near-round hole that fits tightly around the entire circumference of the pin has no ability to be distorted for a loose fitment around the pin, other than by stretching or tearing the paper material. Hence, the force needed to withdraw the present invention pin from the punched hole is thus reduced significantly.

An oval shaped pin with an oval anvil cavity 13 creates an oval hole in a conventional punch device, but unless the hole is actually larger than the pin as disclosed here, there is minimal advantage in reducing pull out force. Thus, in one alternative embodiment, an oval pin (not shown) installed in the assembly of FIGS. 1 and 2, with anvil cavity 13 being similarly oval shaped would provide reduced pull out force. In general, it is not required that the pin be precisely round according to the present invention.

Figure 4:
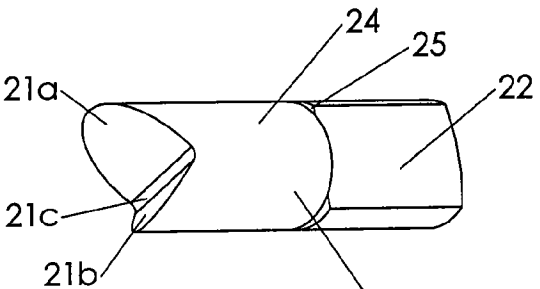
FIG. 4 is a side, bottom perspective view of a pin.

The present invention further contemplates an efficient hole punch design that enjoys reduced cutting forces. In particular, it is preferred that the peak forces are reduced. In a preferred embodiment, an asymmetrical cutting end of the pin enables such reduced peak forces. In FIGS. 2 and 4, it is seen that in the asymmetrical cutting end, lower cutting point 21*a* cuts papers 51 before upper point 21*b* by virtue of the cutting points being at different heights or levels. Therefore, the two cutting points 21*a*, 21*b* cut into papers 51 via different approaches and at different moments in time at any position of pin 20. The different engaging cuts of cutting points 21*a*, 21*b* reduces the overall peak forces since the peak force is the sum of the forces acting on cutting points 21*a*, 21*b* and upper vertex 21*c*, and at a given position of lower point 21*a*, its cutting action occurs when upper point 21*b* is not performing a difficult cutting action. In FIG. 2, lower point 21*a* has broken through the last page of papers 51 and entered anvil cavity 13. The force from lower point 21*a* is past the breakthrough peak. At this moment, upper cutting point 21*b* is performing the peak force entry cut. So the required force on pin 20 is primarily from only one of the two points, namely, upper point 21*b* in the position shown in FIG. 2.

Sequentially, the cutting force peaks when the point 21*a* first enters papers 51, then second point 21*b* engages the papers, and finally when upper vertex 21*c* first enters the papers. In the interim, as the intermediate pages are being cut, the force encountered by pin 20 is lower. As lower point 21*a* cuts through the intermediate pages, upper point 21*b* enters the first page. The two cutting points meet at upper vertex 21*c*. Upper vertex 21*c* may be off center as shown in FIG. 4 so that the two cutting points are at the respective high and low positions while the angle of the cut notch to make the points is the same to each side of upper vertex 21*c*. Cutting points 21*a* and 21*b* are a specified axial distance from vertex 21*c* to define a groove height. Cutting forces may be minimized if the groove height is preferably at least twice the minimum slot height between floor 18*a* and ceiling 18*b*.

Figure 3:
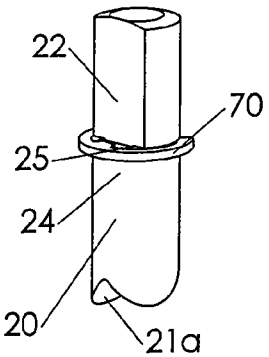
FIG. 3 is a side, top perspective view of a pin and retaining clip assembly.
Figure 3A:
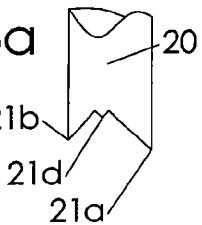
FIG. 3A is a detail view of an alternative embodiment pin cutting end with a "W" shaped profile.

FIG. 3*a* shows an alternative embodiment pin cutting end. Center point 21*d* provides an additional cutting point and additional vertices to create an approximate inverted "W" profile as depicted in the drawing. The "W" profile provides a smooth cutting action near the end of a stroke of pin 20 since the additional vertices are available to shear papers. Also, the center vertex of the "W" profile is preferably slightly off the center axis of pin 20. In various alternative embodiments, the "W" profile may be modified with fewer or additional vertices with peaks of uniform or varying amplitudes, creating a serrated surface. The "W" profile of FIG. 3*a* optionally includes asymmetrical outer cutting points 21*a* and 21*b* similar to the asymmetrical cutting points 21*a*, 21*b* of pin 20 shown in FIG. 4.

In FIG. 2, angled floor 18*c* may serve an additional function to the reduced pin pull out force discussed above. If a symmetrical cutting end is used for pin 20 where cutting points 21*a* and 21*b* are at the same axial position or height on pin 20, the symmetrical cutting points can still cut sequentially, i.e., at different moments in time since the point adjacent to the higher level of floor 18*a*—the left side in FIG. 2—cuts first before the other point. Therefore, the use of angled floor section 18*c* provides reduced cutting force even with symmetrical cutting points. A symmetrical pin may then be used in combination with angled floor 18*c* to provide sequential cutting end action. Or a slightly asymmetrical pin may be used and the angled floor enhances the sequential cutting action.

It is desirable that pin 20 maintain a fixed rotational position in frame 10, especially when the floor of slot 19 is not perpendicular to the pin axis. With a fixed rotational pin position, a particular cutting point, 21*a* in this example, always faces left in FIG. 2 and into the page in FIG. 1 where the point is adjacent to the highest part of anvil cavity 13. One advantage of a fixed rotational position is to ensure the sequential cutting action described above. In FIG. 2, cutting points 21*a* and 21*b* are held to each side of the step in the floor of slot 19. So even if the cutting ends are at the same level, the points still cut in sequence: point 21*a* first and point 21*b* next.

In the FIGS. 3 and 4 embodiments, pin 20 has an optional flat outer surface 22. Thus, pin 20 includes a wide, D-shaped transverse cross-sectional area in the portion with flat side surface 22 where flat surface 22 transitions to a curved outer surface of pin 20. Top hole 15 of frame 10 includes substantially flat interior surface 16 acting as a keyway, as best seen in FIG. 5. Surface 16 may be slightly arcuate. The respective flats 16, 22 are thus keyed to each other. When assembled together, pin 20 slides axially in frame 10 while supported by top hole 15 and guide hole 14. Pin 20, however, cannot rotate because the keyed flat side 22 engages corresponding flat surface 16.

In an alternative embodiment, pin 20 may be keyed to frame 10 by means of a protrusion fitted to a longitudinal groove of the pin (not shown). For example, top hole 15 may have an inward extending tab and pin 20 may have a corresponding longitudinal groove to receive the tab. The keyed flats 16, 22 of the illustrated embodiment are easier to manufacture than a groove machined into a pin since flat 22 is a single surface extended to connect two edges of the cylindrical outer surface of pin 20. Flat surface 22 can be cut in a direction perpendicular to the pin axis. In contrast, a longitudinal groove or keyway must be milled along the direction of the pin axis increasing manufacturing cost and complexity.

When papers 51 are incompletely punched, a paper chip can remain attached or dangling from the stack of papers. In the prior art hole punches, this condition often causes a jam; the chip becomes wedged in slot 19 and the papers cannot be removed from the hole punch device. The present invention, on the other hand, contemplates that if the circular chip is cut in a predetermined direction, this ensures that the chip cannot become wedged.

Figure 7:
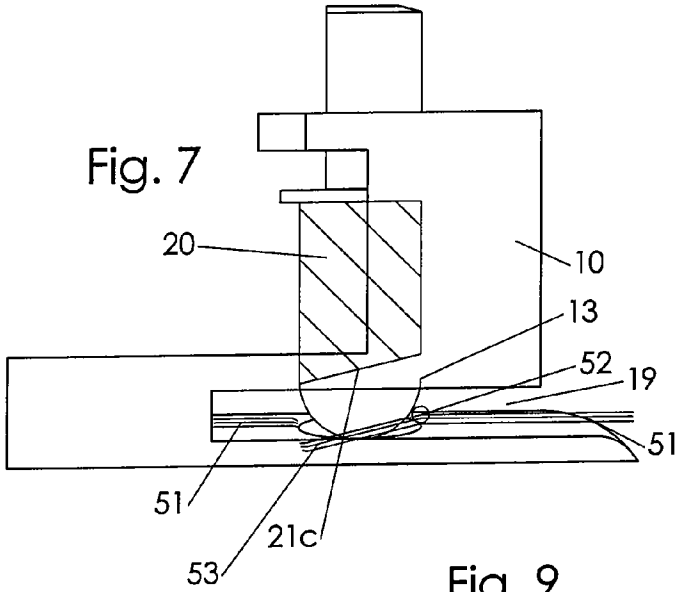
FIG. 7 is a partial cross-sectional view of the element of FIG. 1 with the pin moved down to an intermediate position.

To illustrate, in FIG. 7, a partially punched stack of papers is shown. Chip 53 represents the small, stacked, circle of paper that is to be cut out. The individual chips are incompletely severed from the stack of papers and are attached by tabs 52 dangling the chips. In the exemplary embodiment of the present invention, upper vertex 21*c* is rotationally oriented as shown with the lowest part of vertex 21*c* preferably positioned away from the open end of slot 19, i.e., to the left in FIG. 7. The highest end of vertex 21*c* is thus rotationally oriented nearest tab 52. If there is incomplete cutting, tab 52 is most likely located near the open end of slot 19. With this pin 20 and vertex 21*c* orientation, if chip 53 remains attached to the stack of papers at tab 52, papers 51 can still be forcibly removed from slot 19 after pin 20 is raised since tab 52 cannot catch on any part of pin 20 or the surrounding hole punch structure. Further, chip 53 flexes about tab 52 and swings back in plane with the surrounding paper material as the papers are pulled from slot 19, i.e., toward the right in FIG. 7.

On the other hand, if vertex 21*c* were angled oppositely to that shown in FIG. 7, with the lower part of vertex 21*c* located nearest to the open end of slot 19, then chip 53 can become jammed after a partial cut. Specifically, the chip edge presses inside anvil cavity 13 and the chip may bend over into the hole. This can be visualized by assuming papers 51 are forced to move to the left in FIG. 7 (disregarding the terminating left side wall of slot 19). Chip 53 would fold downward into cavity 13 and backward to effectively double the thickness of the papers. The papers will no longer fit in slot 19 and will become jammed. Empirical testing has confirmed this jamming behavior.

The cutting end of pin 20 may comprise different configurations beyond that shown. For example, symmetrical cutting ends may be used. If the floor of slot 19 were angled as discussed below for FIG. 14, then a symmetrical pin has the same benefit as that discussed for FIG. 7. To provide the anti-jamming benefit, the last area to be cut, and therefore the highest cutting edge of pin 20 or lowest area of the floor, should be facing at least generally toward the open end of slot 19. To maintain this orientation of the cutting edge, a rotational positioning feature such as flats 22, 16 described above may be used.

In summary, there are various possible cutting end designs for pin 20 including symmetrical and asymmetrical cutting points. These cutting ends may be used with various designs for the angled segments in the floor of slot 19 such as different angles or shapes as discussed above. For each combination of these variables, an optimum rotational position for pin 20 may be empirically determined where jamming as described in the preceding paragraph is minimized. FIG. 7 shows one such combination and rotational orientation for pin 20. In any combination, the structure described at the upper portion of the pin can hold the pin cutting end in a selected orientation as required.

In an alternative embodiment, an expanding sleeve is used to reduce the pull out force of the pin. FIG. 8 shows components of a paper punch element according to this alternative embodiment. Housing 160 includes slot 165 to fit an edge of a stack of papers. A pin assembly is slidably fitted in chamber 164. According to this embodiment, the pin assembly includes two components, central pin 120 fitted within sleeve 110. Pin 120 at the top end has pin head 124 with a slightly enlarged diameter and near the bottom groove 122 formed around the circumference of the pin. Sleeve 110 has a longitudinal gap 115 spanning end-to-end and an inward extending rib 113 formed in the circumference near the bottom thereof.

Figure 8A:
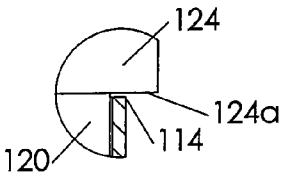
FIG. 8A is a detail view of FIG. 8, showing the top portion of a punch sleeve against a pin head.
Figure 8:
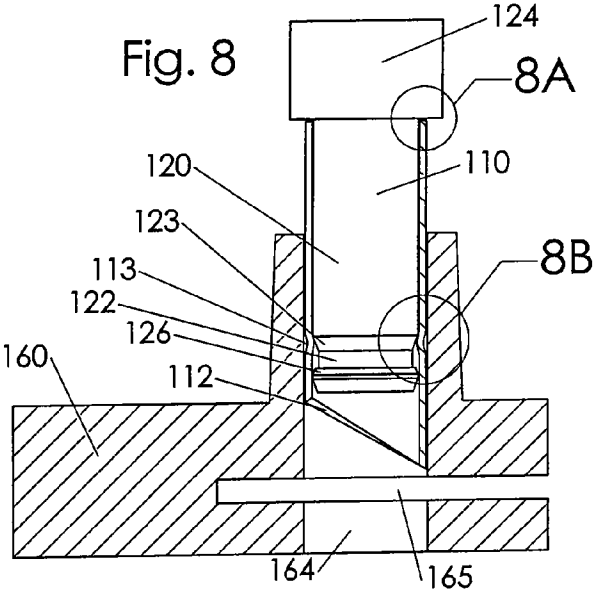
FIG. 8 is a cross-sectional view of an alternative embodiment hole punch element assembly.

Normally, pin 120 is in a rest position with a slightly raised position relative to sleeve 110 as seen by the space between sleeve top edge 114 and head lower face 124*a* in FIG. 8A. Also while in the rest position, rib 113 fits into groove 122, and gap 115 is closed or nearly closed. Pressing down upon pin head 124 forces sleeve cutting end 112 into the papers (not shown). The resulting upward axial force on sleeve 110 and downward force on pin 120 cause pin 120 to slide farther down into sleeve 110, and the space at edge 114 is reduced or eliminated. When the space at edge 114 is reduced or eliminated, continuing to drive down on head 124 concurrently displaces sleeve 110 downward.

Figure 10:
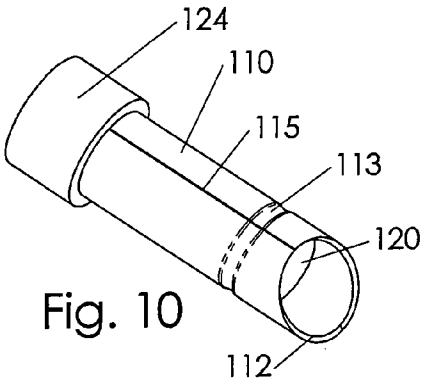
FIG. 10 is a side, bottom perspective view of the pin and sleeve assembly of FIG. 9.
Figure 9:
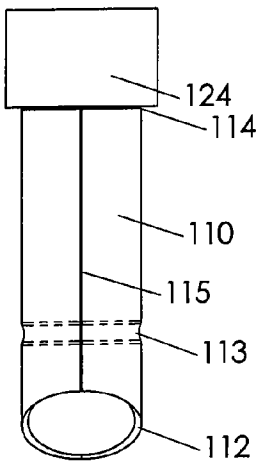
FIG. 9 is a side elevational view of a pin and sleeve assembly.
Figure 8B:
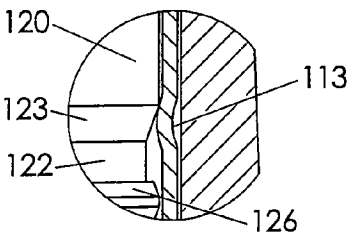
FIG. 8B is a detail view of FIG. 8, showing a rib of the sleeve pressing a groove in the pin.

Groove 122 of pin 120 includes top wall 123 and lower wall 126. As pin 120 slides down within sleeve 110, top wall 123 presses circumferential rib 1 13. The resulting wedge action, as best seen in FIG. 8B expands sleeve 110 into a slightly enlarged diameter. Gap 115 splits farther open enabling the diametrical increase, as seen in FIGS. 9 and 10. This diametrical expansion via increased gap 115 ranges between about 1% to 3% inclusive of the sleeve diameter. During the upward, pull out stroke, sleeve 110 is retained on pin 120 by rib 113 engaging groove lower wall 126.

Sleeve cutting end 112 may be continuously angled so that the hole is cut progressively from one side of the hole diameter to the opposite side. Or cutting end 112 may include two or more cutting points. Sleeve 110 may be formed from sheet steel, where the sharp cutting edge shown is ground before the sleeve is rolled into the tubular shape shown. The sheet steel preferably has some elasticity or resilience. Thus, as the pin assembly of pin 120 and sleeve 110 is pressed through the papers, sleeve 110 easily expands. When the downward pressure is relieved, sleeve 110 contracts to its rest position due to springback, forcing pin 120 upward, restoring space at top edge 114, and closing gap 115. Sleeve 110 is then smaller in diameter than the hole it just created in the paper enabling a low friction pull out of the pin assembly from the hole in the paper. By maintaining preferably about a 1% to 3% diametrical enlargement, gap 115 will not become so large to inhibit cutting action of the lower edge of sleeve 110. Lastly, it is contemplated that the locations of the rib and the groove can be reversed so that the groove is formed in the sleeve and the rib is formed in the pin.

FIGS. 11 to 16 show an alternative embodiment of the solid-pin based punch element of FIGS. 1 to 7. In this embodiment as seen in FIG. 15, pin 80 includes transverse slot 84 with step 83. Frame 60 includes a hollow interior to fit return spring 90. Return spring 90 is preferably a torsion spring. The spring has upper end 91 and lower end 93 and preferably dual coils 92. Coils 92 are positioned remotely from pin 80 rather than coaxial with or adjacent to the pin as with prior art helical return springs. As illustrated, coils 92 are housed within an enclosed space of frame 60 for improved appearance and protection of the spring. Of course, frame 60 may optionally include openings in front wall 65 and/or in one or more of the side walls. Face 85 of pin 80 contacts edge 61 of frame 60 in an uppermost position of pin 80 (not shown) according to one embodiment of a stop structure.

Upper spring end 91 engages slot 84 against step 83. As seen in FIG. 12, lower end 93 fits into recess 62 of frame 60. Lower end 93 preferably includes an optional bent segment as shown to extend into recess 62. Upper end 91 presses ceiling 84c of slot 84 in pin 80. Ceiling 84c is optionally angled as shown in FIG. 14 so that return spring 90 is biased to press against vertical shelf 83, to the left in FIG. 14. Return spring 90 therefore provides a lifting bias to pin 80, which must be countered by the user during a downward punching stroke of the pin.

In a preferred embodiment, return spring 90 is a double torsion spring including two substantially concentric coils 92, but other spring configurations such as a leaf spring or cantilevered spring can be used. The function of coils 92 is provided by the helical coiled portion of the spring, where the helical coil for this purpose is the coil of a torsion spring. In the return spring 90 of FIG. 16, two arms 95 are joined by a connecting segment at upper end 91. Arms 95 angle toward each other moving from upper end 91 toward coils 92. Arms 95 may then wrap circumferentially around a portion of the body of pin 80 to retain the spring against the pin. This wrapping retention may act in addition to or instead of the angle bias discussed for ceiling 84c. Arms 95 may include further distinct bends (not shown) to more completely surround or wrap pin 80 from behind the pin. Using the upper and lower fitment of return spring 90 to frame 80 as described, the spring is securely held in the assembly.

Torsion spring coils 92 can store substantial energy in a compact space in contrast to conventional return springs. Such conventional springs have typically been simple compression springs surrounding the pin and pressing a spring clip that is fitted around the pin. With a lower energy helical compression spring as in the prior art, the bias force increases greatly as the pin is pressed downward. But the conventional compression spring cannot fit a large number of coils in the limited space surrounding the pin, and fewer coils mean a higher spring constant k and a stiffer action. An inescapable result of a stiff action is that the force to operate the conventional hole punch is needlessly high as an operating handle is pressed downward toward its limit. This effect is particularly evident when fewer stacked paper sheets are being punched. With conventional hole punches then, most of the effort is used merely to overcome the force of the return spring in many applications. This is best observed by pressing a conventional punch with no papers inserted yet the downward force on the handle is unnecessarily high.

In contrast, torsion spring coils 92 are positioned remotely from and are not placed coaxially with pin 80, as seen in FIG. 14. Arms 95 of spring 90 may be relatively long. Then a given pin displacement causes a relatively small angular deflection of coil 92 resulting in a small increase in spring bias. This is a specific advantage of a torsion spring functioning as a return spring over a helical compression spring fitted coaxially or in parallel to the punch pin.

Optionally, a long, flat bar or other elongated, axially bendable spring may be attached to the punch device at a location remote from pin 80 and extended to pin 80 to bias the pin upward out of the punched hole. In still another alternative embodiment, a helical compression type spring may be remotely mounted from pin 80 with extended upper and lower arms stretching radially from the spring (not shown). More precisely, a helical spring coil may be situated axially parallel along side pin 80 but not be mounted coaxially to pin 80, while the coil terminates in stranded wire arms at respective upper and low ends with the terminal wires extending radially outward toward pin 80. Here, the helical spring is not placed primarily under compression but rather bends along its axis during deflection as the extended arms move toward each other with pin 80. The bending and biasing action of the helical spring as applied to this embodiment is thus similar to coiled torsion spring 90.

As similarly discussed above for FIGS. 1 to 7, pin 80 is axially movable or slidable in frame 60 within lower guide opening 68 and upper guide opening 64. The pin is rotatably fixed by flat 82 of pin 80 abutting flat 66 of opening 64, as best seen in FIG. 13. For manufacturing efficiency, slot 84 and flat surface 82 may extend transversely in a parallel direction as shown.

Pin 80 is further rotatably positioned by engagement with spring 90 as described above. The connecting segment at upper end 91 optionally includes two corners as shown. As spring 90 wraps around pin 80, these two spring corners of upper end 91 engage step 83 to hold pin 80 rotationally. In an alternative embodiment, pin 80 may be positioned primarily or entirely by engagement with spring 90. Other geometries may be used to rotatably link pin 80 to spring 90 or other type of return spring. For example, a helical spring may include one or more wires extending radially to engage recesses or slots in a pin and in frame 60. Alternatively, a flat leaf spring may contact pin 80 at an edge of the flat spring.

There are various constructions for linking a punch pin to an actuating mechanism such as a lever or handle. For example, an annular groove on the pin may fit into a slot of an actuating member. However, the groove cannot rotationally secure or immobilize the pin. To address this rotation, the pin may be notched as a keyway to accept an extension or key from the supporting frame. This then rotationally fixes the pin. But such a notch is difficult to cut into the cylindrical surface of a typical pin. A dowel may bisect the pin through a drilled hole in the pin. This can rotationally secure the pin, but again it is difficult to manufacture. In particular, it is a complicated process to drill through a cylindrical part, and tedious to assemble a dowel into such an assembly.

In FIGS. 12 and 14, tie bar 200 is shown with optional leg 201 extending into slot 84. See also FIG. 15. Tie bar 200 is part of a hole punch device that includes an actuating handle (not shown) similar to handle 107 of FIG. 1. The handle is linked to tie bar 200 to press downward upon the tie bar. The handle is also preferably linked to tie bar 200 so that the tie bar may be pulled upward through, for example, a linkage shown as lever 107 in FIG. 1. Other actuating devices may be used to move tie bar 200 such as a cam, knob, motor, or other user interfaces known in the art. Other configurations for tie bar 200 may be used as well, such as a "U" channel, "Z" form, a bent rod, or flat form.

As tie bar 200 presses pin 80 downward, leg 201 presses lower horizontal wall 84*a* of slot 84. When pulling upward upon pin 80, leg 201 presses upper horizontal wall 84*b* of slot 84. As discussed above, return spring 90 presses ceiling 84*c* immediately above upper wall 84*b*. The term "slot" is intended to encompass the various structures just described that provide the functions of walls 84*a* and 84*b* and ceiling 84*c*. In alternative embodiments, the slot may be in the form of steps, ridges, teeth, serrations, indentations, grooves, or the like. Optionally, ceiling 84*c* and upper wall 84*b* may be a common surface. Then leg 201 remains under return spring 90, but presses upward on upper end 91 of spring 90 directly. Or alternatively, return spring 90 could be located underneath leg 201, and leg 201 presses lower wall 84*a* via a thickness or diameter of return spring 90. Spring 90 then biases pin 80 upward through a thickness of leg 201.

Slot 84 and flat 82 are preferably cut to a depth of about halfway through the diameter of pin 80. This provides a substantial surface for the respective actions of flat 66 and leg 201, as seen in FIG. 13. Flat 82 and slot 84 may be cut from the same direction as shown so that the terminating wall of slot 84 and flat 82 face the same radial direction. Such a structure may be optimal for production since a single machining operation can cut all such features. Alternatively, flat 82 and slot 84 may face opposite or different radial directions. Flat 82 may be modified to include an arcuate portion, curved either along the axial direction (side view) or along the radial direction (end view).

In another embodiment, spring 90 does not engage an individual pin 80. Rather, a return spring acts to bias tie bar 200 upward. The tie bar in turn biases pin 80 upward by pressing upper wall 84*b*. The return spring may be a torsion, helical, flat or bar spring.

Tie bar 200 preferably links to and actuates more than one punch element. Of course, the tie bar may optionally be linked to and operate a single punch element. Lever 107 of FIG. 1 or like actuating devices operate tie bar 200 and tie bar 200 in turn actuates either a single or multiple punch elements. The punch elements are supported by surrounding hole punch structures (not shown). Such structures normally include, for instance, an attachment member to hold the punch element or elements to the device, a linkage to an actuating handle or lever, a ruler with detents for precisely spacing the punch elements a specific distance apart, and a receptacle to receive cut out paper chips.

In FIGS. 11 to 13, frame 60 includes feed slot 69 with floor 69*a* and ceiling 69*b*. Floor 69*a* may have a locally angled portion as described in connection with FIGS. 1 to 7. In the embodiment shown in FIG. 12, however, the locally angled portion includes a "V" shaped indentation in floor 69*a* having sides 67 angled off the perpendicular to the pin axis and meeting at vertex 67*a*. The "V" shaped indentation is formed with opposed sides 67 bending downward from the generally flat surface of floor 69*a*; the legs of the "V" span the area of floor 69*a* local or proximate to each pin 80. In various preferred embodiments, the span of the legs of the "V" shaped indention falls within a range of about just under 10% of the pin diameter up to 5 pin diameters. The indented sides 67 are partly visible in FIG. 13. In FIG. 12, papers 51 are deflected out of plane to approximately follow the "V" profile. As pin 80 is retracted after cutting a hole in papers 51, the papers are slightly lifted and flattened against ceiling 69*b*; this lifting and flattening re-orients the angle of the papers in the area of the pin to be approximately perpendicular to the pin's elongate axis.

The punched hole is elongated on each side of the basic circular opening to form an oval shaped hole similar to that shown in FIG. 6. The retraction or pull out force is thus reduced as discussed earlier. Alternatively, the indentation in floor 69*a* may be a "U" shape, a groove, a dip, a channel, a step down or other profile including simply a lowered central area. For best performance, it has been empirically determined that the angle of sides 67 should be preferably between about 5° to 25° inclusive, including all angles therebetween, relative to the surrounding floor 69*a* or relative to a perpendicular off the pin's elongate axis. In still other alternative embodiments, the angle of sides 67 may fall within a range of about 2° to 90° inclusive. As discussed for FIG. 2, the preferred angle corresponds to a change in elevation. Across the pin diameter the indented design of FIG. 12 includes half the elevation change compared to a single angled segment for an equal angle of the segments. This is because the angle extends for half the distance, one half the pin diameter according to the current trigonometric relationships. Therefore, to use the figures from the discussion of FIGS. 1 to 7, the angular range of 5° to 25° corresponds to a vertex 67*a* that is lower than floor 69*a* by a depth ranging from about 4% to 25% of the pin diameter.

Another way to describe the angled floor section is in relation to a paper guide slot in a multi-element hole punch. In an assembly of a hole punch structure (not shown), two or more punch elements like that shown in FIG. 12 are spaced side-by-side to provide for separate holes in a stack of papers. Individual feed slots 69 of the two punch elements collectively define the paper guide slot, with at least one portion of floor 69*a* being the bottom of the slot. The paper normally lies in the plane defined by a same portion of the floor 69*a* on each spaced punch element. This plane may be called the "slot plane." The slot plane may be visualized in its relevant direction by the extended direction of papers 51 in FIG. 12. It is described by a general level for floors of adjacent spaced elements to define the position of papers 51. Indented and sloped sides 67 have a local, approximately 5° to 25° out of plane area or bend near to each pin 80. This local slope or bend guides the paper out of plane, or offset, near pin 80 when the paper is pressed by pin 80. The term "plane" is intended to include a non-linear floor for the in and out direction, i.e., left to right in FIG. 11. The path defined by floor 69*a* and indented sides 67 may alternatively be characterized as a bent line bisecting the respective pin axes of the multiple punch elements rather than a bent plane connecting the multiple punch elements.

A further alternative embodiment of the present invention is shown in FIG. 14. Floor 369 is angled front-to-back into feed slot 69, i.e., side-to-side in the profile view of FIG. 14 or between closed rear end 69*c* of feed slot 69 and the opposed open front end. The angle of floor 369 may slope from low to high in the left-to-right direction in FIG. 14 to provide a large open front end, or be sloped from high to low (not shown) to provide a small open front end.

Several benefits are realized with front-to-back angled floor 369. In FIG. 14, pin 80 is shown in an intermediate position. In this exemplary embodiment, cutting points 21 are symmetrical meaning that they are at the same axial position of pin 80. However, for the selected rotational position of pin 80 shown, the cutting points press into the papers (not shown) held in feed slot 69 in a sequence of right to left due to the angled or sloped floor 369. The required force to cut a hole with this symmetrical pin is thereby reduced comparably as with an asymmetrical pin.

A reduced cutting force can also be achieved if the "V" indentation of sides 67 of FIG. 12 is located off center (not shown) with respect to the pin axis. In such an arrangement, a symmetrical pin presses each side 67 and then the papers upon the sides 67 in this sequence. These effects are similar to that discussed earlier for angled floor section 18*c* in connection with FIG. 2. As suggested by the preceding discussion, points of a punch pin may cut in sequence through one or a combination of an asymmetrical pin and/or a non-perpendicular floor of a paper slot with respect to the pin axis. To provide a distinct sequence in pin cutting with a symmetrical pin, the angle of floor 369 should preferably be greater than about 5°.

Another benefit of inward angled floor 369 is realized when the punch element is used with feed slot 69 in a vertical orientation. The angle of floor 369 makes the full depth of feed slot 69 more visible to a user when angled floor 369 optionally tilts toward a user. For example, a punching device may be designed to fit the element in a position rotated 90° clockwise from the position shown in FIG. 14. The device may be designed for use with cutting points 21 normally facing the user. With this arrangement, feed slot 69 extends and opens upward. Feed slot 69 also angles toward the user thus enhancing the convenience for the user. Optional surrounding structures may further guide papers toward and within feed slot 69.

In the exemplary embodiment of the present invention in FIG. 14, ceiling 69*b* is perpendicular to the pin axis. Optionally, ceiling 69*b* may angle in the same direction as floor 369 to more clearly define an insertion orientation for papers. Or ceiling 69*b* of FIG. 14, or any other illustrated punch element, may angle away from floor 369, or 69*a*, to provide a wider opening for feed slot 69 to facilitate inserting papers. In either of these examples, ceiling 69*b* is not perpendicular to the pin axis.

A still further benefit of angled floor 369 of feed slot 69 is that pin 80 creates an oval hole in papers if the angle off perpendicular from the pin axis is greater than about 5° and less than about 25°. The front-to-back angle of floor 369 may rise upward toward rear closed end 69*c* as shown in FIG. 14, or floor 369 may alternatively angle downward toward closed end 69*c*. The cutting and pull out benefits as described are equal. This pin pull-out force reduction is analogous to the force benefits discussed in connection with FIG. 2 and side-to-side angled floor 18*c*, and with the indentation with sides 67 in the FIG. 12 embodiment. If ceiling 69*b* is perpendicular to the pin axis, then the pin pull out force is reduced as discussed in connection with FIGS. 2 and 12.

Creating the oval hole using angled base 369 also allows a sharp angle while maintaining a compact slot height because there is no cumulative increase in height over a long distance. As with angled section 18*c* of FIG. 2 or "V" sides 67 of FIG. 12, the angle of base 369 and the associated elevation change are localized to each punch element.

In FIGS. 11 and 14, frame 60 includes an outer, upper, lead-in surface 65 that is angled and a lower lead-in surface 63. Upper lead-in surface 65 angles closer to pin 80 when moving toward a termination at slot 69. In FIG. 14, lead-in surface 65 provides a paper lead-in guide into slot 69. Importantly, lead-in surface 65 is angled for substantially the full height of frame 60 above slot 69. By contrast, conventional punch element frames include such a lead-in surface only as a filleted transition between the paper slot and the outer surface, similar to the area shown in FIG. 11 as the corner where upper lead-in surface 65 joins ceiling 69*b*. But upper lead-in surface 65 includes an angled or curved profile along most or all of the length of pin 80, unlike conventional designs. Indeed, frame 60 includes lower guide opening 68 and upper guide opening 64. Upper lead-in surface 65 includes a length parallel to the pin axis extending between near the levels of these respective openings 68, 64. Along the length of upper lead-in surface 65, the surface angles closer to pin 80 moving from the level of upper guide opening 64 down toward lower guide opening 68. Lead-in surface 65 may alternatively form an enclosing wall of the enclosed space of frame 60 as shown. The upper lead-in surface 65 thus provides an effective guide to help position papers within slot 69 at the location of the punch element.

It is understood that various changes and modifications of the preferred embodiments described above are apparent to those skilled in the art. Such changes and modifications can be made without departing form the spirit and scope of the present invention. It is therefore intended that such changes and modifications be covered by the following claims.

What is claimed is:

1. A hole punch element of a hole punch device, comprising:

a frame guiding a substantially cylindrical punch pin at a location along a respective pin axis;

wherein the frame includes a slot, and the pin axis extends along a height of the slot from a ceiling of the slot to a floor of the slot, and wherein the ceiling and the floor of the slot define a space able to receive paper sheets therebetween, and the floor includes a pin guide opening forming an anvil cavity in the floor aligned with the pin axis;

wherein the slot includes a front, a rear, a left side, a right side, the slot being terminated by a wall at the rear of the slot and the slot is open at the sides and at the front opposite the wall, and the paper sheets extend between the sides of the slot;

wherein the floor further includes an angled section extending in a non-perpendicular direction from the pin axis and in a non-parallel direction from the ceiling, the angled portion being angled to include an axial elevation change across the anvil cavity of between about 8% to 50% inclusive of the pin diameter to form first and second floor levels, one at each side of the anvil cavity; and wherein the angled portion is angled with respect to a direction extending substantially completely across the anvil cavity, the floor is offset between the first and second floor levels at the location of the punch pin, and the first and second floor levels are respectively spaced by substantially different distances from the ceiling.

2. The hole punch element of claim 1, wherein the floor includes a maximum angle in relation to the pin axis from about 5° to 25° inclusive, at the location of the punch pin.

3. The hole punch element of claim 2, wherein the angle is about 10° to 15° inclusive.

4. The hole punch element of claim 3, wherein the angle is about 11°.

5. The hole punch element of claim 1, wherein the ceiling is opposite the floor and includes a further pin guide opening, and the ceiling is substantially perpendicular to the pin axis.

* * * * *